US005117891A

United States Patent [19]

Simon

[11] Patent Number: 5,117,891

[45] Date of Patent: Jun. 2, 1992

[54] CONSUMER SIZABLE AND INSTALLABLE FABRIC TYPE WINDOW SHADE AND METHOD OF MANUFACTURE THEREOF

[75] Inventor: Terry L. Simon, Rockford, Ill.

[73] Assignee: Newell Opeating Co., Freeport, Ill.

[21] Appl. No.: 487,569

[22] Filed: Mar. 2, 1990

[51] Int. Cl.[5] ..... A47G 5/02

[52] U.S. Cl. ..... 160/263; 160/237

[58] Field of Search ..... 160/263, 121.1, 237, 160/250, 405; 428/43, 155, 167

[56] References Cited

U.S. PATENT DOCUMENTS

| | | | |
|---|---|---|---|
| 4,006,770 | 2/1977 | Ferguson | 160/263 |
| 4,102,384 | 7/1978 | Gossling et al. | 160/263 |
| 4,102,385 | 7/1978 | Miller | 160/263 |
| 4,247,599 | 1/1981 | Hopper | 160/121.1 X |
| 4,438,799 | 3/1984 | Comeau | 160/263 |
| 4,539,238 | 9/1985 | Markowitz | 160/263 X |
| 4,539,239 | 9/1985 | Graves et al. | 160/263 X |
| 4,566,517 | 1/1986 | Simon | 160/263 |
| 4,619,305 | 10/1986 | Comeau | 160/263 |

*Primary Examiner*—David M. Purol
*Attorney, Agent, or Firm*—Baker & McKenzie

[57] ABSTRACT

A do-it-yourself-without-tools window shade which is width adjustable and installable by the consumer at the point of installation without the use of tools or cutting elements is disclosed. The window shade includes a composite sheet structure of a plastic sheet and a fabric sheet laminated to one another by a conventional plasticizer based adhesive under the action of heat and pressure. The composite sheet structure includes a plurality of parallel cut lines which extend all the way through the fabric layer and into the plastic layer to a predescribed depth thereby enabling the consumer to strip the sheet structure to its proper width.

9 Claims, 1 Drawing Sheet

Fig. 1.
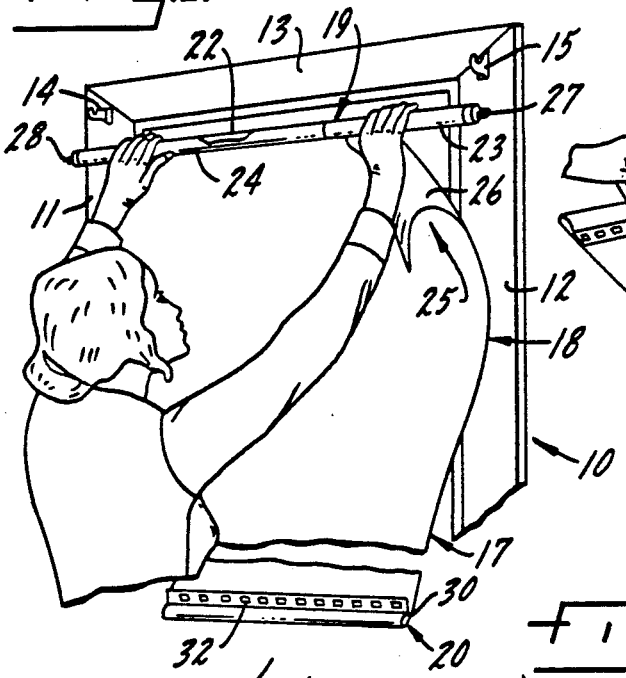
Fig. 2.
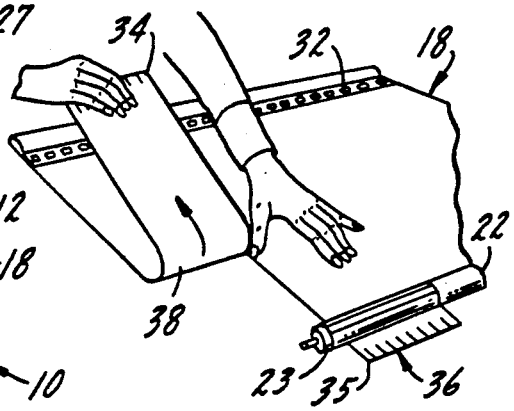
Fig. 4.
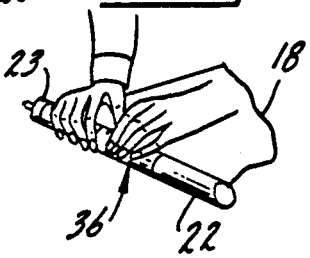
Fig. 5.
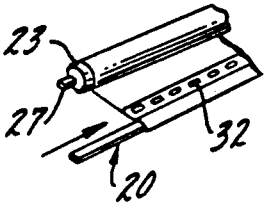
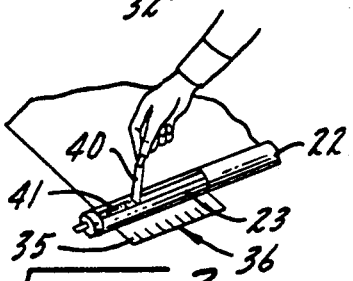
Fig. 3.
Fig. 7.
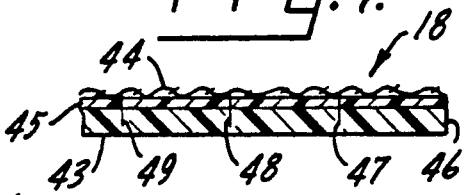
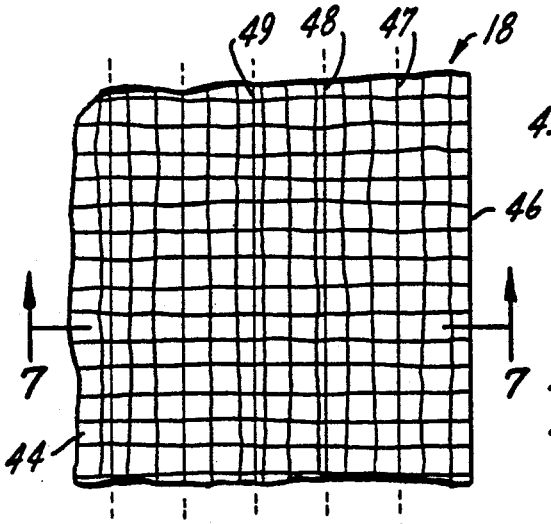
Fig. 6.
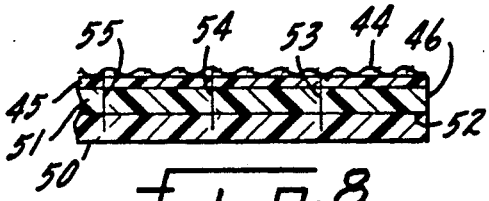
Fig. 8.

CONSUMER SIZABLE AND INSTALLABLE FABRIC TYPE WINDOW SHADE AND METHOD OF MANUFACTURE THEREOF

This invention relates generally to the type of window shade often referred to as a do-it-yourself-without-tools window shade, and specifically to such a shade having a fabric disposed on one side of the shade sheeting, usually the room side.

Do-it-yourself-without-tools window shades are universally, to the best of applicant's knowledge, composed of a shade member formed entirely of plastic material. Such shades have several cut or score lines formed therein which penetrate part way through the body of the sheeting from one surface and are parallel to an outer edge of the sheet. The consumer, who may have purchased the window shade without knowing the exact width of the window in which it is to be installed, is able, by selecting an appropriate strip or tear line delineated by the cut or score lines, to shorten the width of the shade to the exact width of the window at the time of installation by tearing along one of the cut lines. All of the foregoing is accomplished without the use of hand tools.

Although such shades represent a marked improvement in the window shade industry in the past 15 years, such shades have been limited to plastic sheeting. The sheeting has been varied in terms of thickness, color and textural appearance and a wide selection is presently available. However, the softness, wide range of textural qualities and other attributes of fabric deemed desirable by consumers has not been achievable in a do-it-yourself-without-tools window shade because no way has been found to combine the highly desirable characteristics of fabric with the ease of purchase and installation, and low cost, of the plastic do-it-yourself-without-tools window shade.

SUMMARY OF THE INVENTION

The present invention provides the ease of purchase and installation of do-it-yourself-without-tools window shades together with fabric to provide a rugged, aesthetically pleasing fabric window shade at the low level of cost associated with the plastic do-it-yourself-without-tools window shade. The consumer need not purchase a fabric shade from a specialty source, such as a custom shop, and pay the high price associated with conventional made to measure on a special order basis fabric shades. Instead, a combined fabric and plastic window shade, which can be even more rugged than a conventional fabric shade, can be purchased at mass market prices with the result that a final appearance equal to, or possibly better than, conventional fabric shades can be obtained. This is accomplished by providing a composite fabric and plastic sheet structure in a basic do-it-yourself-without-tools window shade assembly. The fabric is adhered to the plastic, preferably by means of an adhesive, heat and pressure, to form a rugged product which, to the eye of the observer in a room in which such a shade is mounted, has all the pleasing characteristics of a conventional fabric shade.

Alternatively, the strength and desirability of the window shade may be increased by forming the plastic portion of the shade from two or more separate plies of plastic sheeting so that the final product is extremely strong and long wearing.

DESCRIPTION OF THE INVENTION

The invention is illustrated more or less diagrammatically in the accompanying drawing wherein:

FIG. 1 illustrates the step of sizing the window shade assembly of this invention during the installation process by the final user, which, in this instance is shown to be a home dweller;

FIG. 2 illustrates the subsequent step of stripping the window shade assembly to its proper width following the sizing step;

FIG. 3 illustrates the subsequent step of fixing the upper end portion of the composite sheet member of the window shade assembly which is not initially in fixed relationship to the roller to a roller assembly;

FIG. 4 illustrates a subsequent step in the assembling process;

FIG. 5 illustrates the step of inserting slat means into the lower end portion of the window shade assembly;

FIG. 6 is a top view of a small portion of the composite sheet structure at one edge of the structure to an enlarged scale;

FIG. 7 is a view taken substantially along line 7—7 of FIG. 6; and

FIG. 8 is a cross sectional view similar to FIG. 7 of an alternative composite sheet structure having a multi-ply plastic sheet construction.

Like reference numerals will be used to refer to like parts from Figure to Figure of the drawing.

In FIGS. 1 through 5 inclusive, the new and improved window shade of this invention, and its method of installation by the final user, is illustrated.

In FIG. 1 a window frame to which the improved window shade of this invention is to be secured is indicated generally at 10, the frame consisting of left side frame member 11, right side frame member 12 and top frame member 13. Conventional window shade brackets are indicated at 14 and 15, right bracket 15 being adapted to receive a conventional flatted end pin of a window shade roller assembly, and left bracket 14 being adapted to receive a conventional round end pin.

The window shade assembly is indicated generally at 17. It includes a sheet member, indicated generally at 18, which will be described in greater detail hereinafter, a telescopic roller assembly, indicated generally at 19, and a slat assembly, indicated generally at 20.

The sheet member 18 is a composite structure formed from a material having the characteristics, with respect to compressibility, strength and formability, of plastic, and a fabric. One suitable plastic material is polyvinyl chloride, although other materials such as polyethylene, polypropylene and polyolefins may be used. Also the product known as Mylar may, in certain circumstances be employed. For purposes of further description it will be assumed that, for the plastic component of the composite structure, a polyvinyl chloride flexible sheet, or sheets, whose thickness lies in the range of from about 8 mils to about 11 mils will be used. It should be understood however that the thickness, or depth, of the material from which the sheet member is formed may be somewhat thinner, or somewhat thicker than the above mentioned range, dependent upon other factors, such as cost, handling ability, side strength, and cutting ability, all as will appear hereinafter.

Further, if two or more sheets of plastic are employed to form the plastic component of the composite structure, the thicknesses of the individual sheets may be of such dimensions as are easily handled and conveniently available. For example, if a plastic component of about 8 mils thickness is desired, two sheets of 4 mils each, or one sheet of 3 mils and one sheet of 5 mils may be used. If a plastic thickness of about 11 mils is desired, sheets of 3, 4, and 4 mils, or of 5 and 6 mils, may be used. At the present stage of technology, seven mils appears to be somewhat too thin, and starting about 12 mils the structure may become too thick to roll correctly.

If two or more plies of plastic are used they are laminated to one another under heat and pressure. It has been found that pressure of about 350 pounds per square inch and temperatures of about 300 degrees F. will result in a fusing of the plastic layers to one another to the point where the multiple layers become, in effect, one sheet.

The fabric component of the composite structure may be a fabric of the type conventionally used in the curtain industry. However it must have certain traits that help conceal the cut lines. The fabric can have virtually any surface texture from almost a burlap type surface to a relatively smooth surface. The thickness is preferably a few mils, depending to a considerable extent on the thickness of the plastic component. If for example a plastic thickness of 11 mils is used, the fabric may preferably be only about 6–8 mils; if the plastic thickness is about 8 mils, the fabric should be less also, such as 4 to 6 mils.

The fabric is bonded to the plastic component by a conventional plasticizer based adhesive. The same pressures and temperatures used to fuse the multiple plastic layers, when multiple layers are used, will plasticize the adhesive and cause a good bond to be formed between the fabric and the plastic. Care of course should be taken to ensure that there is a reasonable match between the fabric and the plastic components of the composite structure 1 from the standpoint of co-efficient of expansion and contraction.

Irrespective of what plastic type material is employed however the material will have a plastic memory whereby the material, when deformed, as by cutting to a depth less than the thickness of the material, tends to return to its original configuration.

The telescopic roller assembly illustrated in FIG. 1 consists of an outer, larger diameter section 22 and an inner, smaller diameter section 23. The inner section 23 is received within the outer section 22, and the inner section 23 is slideable with respect to the outer section 22 so that the overall length dimension of the telescopic roller assembly (which represents the width of the window shade) may be adjusted as needed. As indicated in FIG. 1, the left portion 24 of the upper end portion 25 of the sheet member 18 is affixed to the outer, larger diameter roller section 22 at the point of manufacture by any suitable means, and, in this instance, is wrapped once therearound.

The right portion 26 of the upper end portion of the sheet member is not connected to, or located in fixed relationship with respect to the telescoping roller assembly at the commencement of the sizing operation in the installation process, for purposes which will be explained hereinafter.

The right end of the inner roller section 23 includes a conventional flatted end pin assembly 27, and the left end portion includes conventional round end pin assembly 28. The telescopic roller assembly includes a conventional shade motor assembly, but since the construction and operation of the shade motor is conventional, it is not illustrated or described.

The lower end portion of the sheet member has been doubled back and fastened to itself to form a slat pocket, indicated generally at 30, in which a slat assembly 20 is received. Any suitable means may be employed to secure the doubled back edge of the sheet member to the body of the sheet member. In this instance a plurality of heat seals have been employed, indicated at 32, which heat seal locations are carefully selected as will be apparent hereinafter.

In the sizing step illustrated in FIG. 1, the installer, here a home dweller, is holding the telescopic roller assembly up to the window shade brackets 14 and 15 in order to size the shade. The inner telescopic roller section 23 is then slid inwardly, or to the left as viewed in FIG. 1, into the outer telescopic roller section 22 in order to correctly adjust the overall length of the telescopic roller assembly, and thereby the width of the shade. Preferably the telescopic roller assembly is placed in the brackets 14 and 15 to ensure correct sizing.

Thereafter the roller is removed from the bracket without changing the relative positions of the inner and outer telescoping roller sections. The window shade is then placed on a flat surface such as a table or a floor as indicated in FIG. 2.

Referring now to FIG. 2 it will be noted that the right portion 26 of the upper or top end portion 25 of the shade has a series of tabs formed therein, two of which are indicated at 34 and 35. Each tab is formed by a cut which extends completely through the material from which the sheet member is formed, commencing from the top edge.

As will be explained in detail hereinafter each tab actually represents the terminus of a continuous cut which is formed within the body of the flexible material, each tab being defined by the ends of two adjacent continuous cuts, also sometimes herein referred to as cut lines. Each cut line extends continuously from the upper end portion of the sheet member to the lower edge, and penetrates inwardly from one surface of the sheet member a distance less than the thickness of the sheet member.

Typical depth of penetration in a material having a plastic thickness of about 8 mils to about 11 mils is 5 mils to 8 mils or somewhat less. It should be understood however that penetrations of greater or lesser depth may be employed, the only requirement being that the depth of penetration of the continuous cut line be sufficient to enable the excess, unneeded material at the side of the shade to be peeled or stripped easily by hand applied pressure of the point of installation, and that the depth of material lying between the bottom of the continuous cut and the other side of the shade has sufficient strength to resist deformation; i.e.; premature separation of the sheet member when exposed to normal manufacturing, transportation and handling stresses to which the sheet member may be subjected prior to and during final installation.

As illustrated in FIG. 2 the installer had determined that the cut line which lies between tabs 34 and 35 represents the correct shade width, and, accordingly, after grasping the sheet member to the left of the cut line with one hand, and to the right of the cut line with the other hand, the excess material, represented at 38, is being stripped away.

Heat seals 32 are located between adjacent continuous cut lines at the bottom end portion of the composite sheet structure 18. Accordingly, when the peeling action reaches the bottom of the shade, the installer, with the exercise of reasonable care, is able to tear around the slat pocket so that the entire excess portion 38 may be easily removed. It will be understood of course that the slat assembly 20 will have been removed prior to the stripping of the excess portion of the sheet member.

After the sheet member has been stripped to its proper width, the installer pulls a protective paper strip 40 away from an adhesive substance 41 which is coated on the inner section 23 of the telescopic roller assembly as best illustrated in FIG. 3. The protective paper strip is peeled away only to the point where the right edge of outer telescopic roller section 22 begins. After the protective paper strip is peeled away the remaining unattached portion 36 of the upper end portion of the sheet member is, in the specific illustrated embodiment, wrapped around the inner telescopic roller section 23 and secured thereto by means of the adhesive 41, as best illustrated in FIG. 4. It will be noted that it is not essential that the upper initially (i.e.: as manufactured) loose, right end portion of the composite sheet number 18 be adhered or otherwise made fast in a smooth manner with the smaller diameter roller 23 by being pressed against it. It may, for example, be desirable to include a sleeve of cardboard or other suitable material over the smaller diameter roller 23, the outer diameter of the sleeve being equal to the outer diameter of the larger diameter telescopic section 22 of the roller assembly. The sleeve may have cuts or separations therein coinciding with the cut lines 47–49. The upper, initially loose, right end portion of the composite sheet member 18 would then be adhered or otherwise made fast in a smooth manner with the sleeve.

In either event, the upper, initially loose, right end portion of the composite sheet member 18 would be in fixed relationship to, albeit slightly space from, the roller assembly 19.

Thereafter the slat assembly 20 is reinserted in the slat pocket 30.

The window shade is now inserted in brackets 14 and 15 and is ready for use.

Referring now to FIGS. 6 through 8, and initially to FIGS. 6 and 7, a unique aspect of the invention will be described in detail.

The top plan view of the composite sheet structure 18 is formed, in the embodiment of FIGS. 6 and 7 of two separate and discrete elements, a plastic sheet 43 and a fabric sheet or layer 44. The plastic and fabric sheets are preferably laminated to one another by means of a conventional plasticizer based adhesive 45 under the action of heat and pressure. Pressures on the order of 350 pounds per square inch and temperatures on the order of about 300 degrees Fahrenheit, or even somewhat less, will activate the adhesive 45 and cause a strong adherence of the fabric 44 to the plastic sheet 43.

The edge of the sheet is indicated at 46 and a plurality of cut lines are shown at 47, 48, and 49. The cut lines run parallel to edge 46 and, preferably, the entire length of the sheet. As illustrated, the cut lines extend all the way through the fabric layer 44 and into the plastic layer 43 to the depth described earlier. As mentioned above, the cut lines may extend all the way through the composite structure at the upper end to form discrete tabs 34, 35 which can be grasped and used as starting guides for the peeling or stripping step illustrated in FIG. 2. Alternatively, separate discrete tabs, or other indicators, (such as scallops) of the locations of the cut lines, may be formed in the bottom end portion of the composite sheet member 18. One advantage of forming the tabs 34, 35 in the upper end is that the lower edge can be straight which is preferred by many consumers. Further, raw plastic and fabric sheet stack may be more economically utilized generally and the cutting process may be simplified if straight edges are formed at the top and bottom of the sheet member 18.

In the alternative embodiment of FIG. 8, the plastic structure is formed from two sheets or layers of plastic, indicated at 50, 51. The application of the above described pressures and heat cause the two plastic sheets to, in effect, fuse together in the abutting regions indicated at 52 so that the two, or more, layers of plastic becomes one. Preferably the cut lines 53-55 extend downwardly from the room side 44 of the composite sheet to a location within the lower sheet 50.

It is believed that two layers will be most practical. However, the number of layers is not exceedingly critical since, after lamination, the plastic layers become in effect one ply. It is believed that the laminated construction adds strength to the vinyl. It is preferred that the yarn used to knit the fabric be basically one thickness to preclude the possibility of the scoring blades cutting too deep where the yarn is thinner and not deep enough where the yarn is thick. Vertical patterns in the fabric may help to hide the cut lines but this is not essential since the state of technology reached by the assignee is such that the cut lines are practically invisible to the naked eye just a short distance away from even a smooth surfaced sheet. It appears, at present, that it is desirable that the cutting go all the way through the fabric to avoid the possibility of cross threads interfering in the stripping operation.

Although a preferred embodiment of the invention has been illustrated and described, it will be understood that the foregoing description is intended to be exemplary and not definitive. Accordingly it is intended that the scope of the invention be defined, not by the scope of the foregoing description, but rather by the claims when interpreted in light of the pertinent prior art.

I claim:

1. Sheeting for use in a window shade which can be sized to a desired width at the point of installation without the use of tools, said sheeting including, in combination, a layer of fabric material, plastic sheeting underlying the fabric material, said plastic sheeting being solid, means for securing the layer of fabric material to the plastic sheeting to thereby form a composite structure, and at least one line of weakness in said composite structure, the portion of the line of weakness in the fabric layer portion of the composite structure consisting of a cut extending completely through said fabric layer to thereby sever the fabric, the portion of the line of weakness in the underlying plastic sheeting consisting of a cut extending part way into, but not all the way through, the plastic sheeting, the depth of the plastic sheeting directly underlying said cut being sufficiently thin to enable easy separation of the plastic sheeting, and thereby the composite structure, upon the application of a hand separating force applied to the end portion of the line of weakness in said composite structure, the depth of the plastic sheeting directly underlying said cut being sufficiently thick to resist premature separation of the composite structure when subjected to normal manufacturing, transporting, and handling stresses prior to a hand-applied separation force to the end portion to the line of weakness at the point of installation.

2. The composite sheeting structure of claim 1 further characterized in that the plastic sheeting is composed of a single layer of plastic.

3. The composite sheeting of claim 1 further characterized in that the plastic sheeting is composed of a plurality of layers of plastic.

4. The composite sheeting of claim 1 further characterized in that the means for securing the layer of fabric material to the plastic sheeting is an adhesive.

5. A do-it-yourself-without-tools window shade which is width adjustable and installable by the consumer at the point of installation without the use of tools or cutting elements, said do-it-yourself-without-tools window shade including, in combination, a roller assembly, sheeting which can be sized to a desired width at the point of installation without the use of tools, said roller assembly being width adjustable at the point of installation to accommodate a desired width of sheeting, and means for securing the sheeting to a roller assembly, said sheeting including, in combination, a layer of fabric material, plastic sheeting underlying the fabric material, said plastic sheeting being of a non-foam material, means for securing the layer of fabric material to the plastic sheeting to thereby form a composite structure, and at least one line of weakness in said composite structure, the portion of the line of weakness in the fabric layer portion of the composite structure consisting of a cut extending completely through said fabric layer to thereby sever the fabric, the depth of the plastic sheeting directly underlying said cut being sufficiently thin to enable easy separation of the plastic sheeting, and thereby the composite structure, upon the application of hand separating force applied to the end portion of the line of weakness in said composite structure, the depth of the plastic sheeting directly underlying said cut being sufficiently thick to resist premature separation of the composite structure when subjected to normal manufacturing, transporting, and handling stresses prior to a hand-applied separation force to the end portion of the line of weakness at the point of installation.

6. The do-it-yourself-without-tools window shade of claim 5 further characterized in that, the plastic sheeting is composed of a single layer of plastic.

7. The do-it-yourself-without-tools window shade of claim 5 further characterized in that the plastic sheeting is composed of a plurality of layers of plastic.

8. The do-it-yourself-without-tools window shade of claim 7 further characterized in that the individual layers of plastic are secured to one another by fusion derived from heat and pressure.

9. A method of manufacturing composite do-it-yourself-without-tools window shade sheeting which can be reduced to a final desired width by hand without the use of tools or cutting elements, said method including the steps of providing a layer of fabric material, providing a layer of plastic sheeting, positioning said fabric material and said plastic sheeting with the fabric material overlying the plastic sheeting, securing the fabric material to the plastic sheeting to form a composite structure, forming a line of weakness in the composite structure by cutting completely through the fabric material and part way into, but not all the way through, the plastic sheeting, the depth of penetration of the cut into the plastic sheeting being far enough to provide easy separation of the plastic sheeting, and thereby the composite structure, upon the application of a hand-applied separating force applied to the end portion of the line of weakness in said composite structure, the depth of the uncut plastic sheeting directly underlying said cut being sufficient to resist premature separation of the composite structure when subjected to normal manufacturing, transporting, and handling stresses prior to hand-applied separation to the end portion of the line of weakness at the point of installation.

* * * * *